US006347574B1

(12) United States Patent
Guentert et al.

(10) Patent No.: US 6,347,574 B1
(45) Date of Patent: Feb. 19, 2002

(54) RADIAL PISTON PUMP FOR PRODUCING HIGH PRESSURE FUEL

(75) Inventors: Josef Guentert, Gerlingen; Klaus Wuerth, Waldachtal; Hans-Juergen Simon, Bad Liehenzell; Thomas Schwarz, Schorndorf; Kasim-Melih Hamutcu, Stuttgart, all of (DE)

(73) Assignee: Robert Bosch, GmbH, Stuttgart (DE)

( * ) Notice: Subject to any disclaimer, the term of this patent is extended or adjusted under 35 U.S.C. 154(b) by 0 days.

(21) Appl. No.: 09/600,914

(22) PCT Filed: Jan. 15, 1999

(86) PCT No.: PCT/DE99/00056

§ 371 Date: Dec. 4, 2000

§ 102(e) Date: Dec. 4, 2000

(87) PCT Pub. No.: WO99/37916

PCT Pub. Date: Jul. 29, 1999

(30) Foreign Application Priority Data

Jan. 23, 1998 (DE) ..... 198 02 475

(51) Int. Cl.[7] ..... F01B 1/00; F04B 1/06
(52) U.S. Cl. ..... 92/72; 92/129; 91/491
(58) Field of Search ..... 92/72, 129, 172; 91/491, 494

(56) References Cited

U.S. PATENT DOCUMENTS

| | | | | | |
|---|---|---|---|---|---|
| 2,000,271 | A | * | 5/1935 | Benedek | 91/494 X |
| 2,032,079 | A | * | 2/1936 | Benedek | 91/494 X |
| 2,163,570 | A | * | 6/1939 | Benedek | 91/494 X |
| 3,628,425 | A | * | 12/1971 | Morita et al. | 91/491 |
| 3,874,271 | A | * | 4/1975 | Eickmann | 91/491 |
| 4,629,401 | A | * | 12/1986 | Grote | 92/72 X |
| 5,823,091 | A | * | 10/1998 | Collingborn | 92/72 X |

FOREIGN PATENT DOCUMENTS

| | | | | |
|---|---|---|---|---|
| DE | 3236076 | * | 3/1984 | 91/491 |
| GB | 1029659 | * | 5/1966 | 91/491 |
| GB | 1436752 | * | 5/1976 | 91/491 |

* cited by examiner

*Primary Examiner*—John E. Ryznic
(74) *Attorney, Agent, or Firm*—Ronald E. Greigg

(57) ABSTRACT

A radial piston pump for generating high fuel pressure in fuel injection systems of internal combustion engines, having a drive shaft which is supported in a pump housing. The drive shaft is embodied eccentrically or has camlike protrusions in the circumferential direction. A plurality of pistons are disposed radially with respect to the drive shaft in a respective cylinder chamber. A plate is mounted on the ends of each piston toward the drive shaft, and the pistons are movable back and forth radially in the respective cylinder chamber by rotation of the drive shaft. Wear problems are solved by providing that the plate is pivotably connected to the associated piston. By the deflection of the plate on the piston, the load on the piston from moments of the bracing force is lessened.

20 Claims, 3 Drawing Sheets

RADIAL PISTON PUMP FOR PRODUCING HIGH PRESSURE FUEL

PRIOR ART

The invention relates to a radial piston pump for generating high fuel pressure in fuel injection systems of internal combustion engines, in particular in a common rail injection system. The piston pump includes a drive shaft which is supported in a pump housing and is embodied eccentrically or has camlike protrusions in the circumferential direction, a plurality of pistons are disposed radially with respect to the drive shaft in a respective cylinder chamber with a plate mounted on the ends, toward the drive shaft, of each of the pistons. The pistons move back and forth radially in the respective cylinder chamber by rotation of the drive shaft.

In such a radial piston pump, braced on the inside, relatively large forces are brought to bear by the rotating drive shaft on the pistons, as a function of the quantities of fuel aspirated into the cylinder chambers, in order to exert pressure on the fuel. In the aspiration, the plate is as a rule moved toward the drive shaft by a prestressed spring.

Within the scope of the present invention, it has been found that the conventionally used plates and/or the pistons are damaged in certain operating conditions, especially when an element is partly filled. These wear phenomena can lead to breakage of the plate and/or pistons and are therefore undesirable.

It is therefore an object of the invention to furnish a radial piston pump which overcomes the above disadvantages. In particular, breakage of the plate and/or of the piston should be prevented. The plate should function without wear in operation, even at high pressures. Perfect operation of the radial piston pump should be assured even if the cylinder chambers are only partly filled. The radial piston pump of the invention should withstand a pump pressure of up to 2000 bar in the pumping direction and nevertheless be economical to manufacture.

This object is attained by the radial piston pump set forth hereinafter. Particular versions of the invention are disclosed herein.

A radial piston pump for generating high fuel pressure in fuel injection systems of internal combustion engines, in particular in a common rail injection system has a drive shaft which is supported in a pump housing and is embodied eccentrically or has camlike protrusions in the circumferential direction a plurality of pistons are disposed radially with respect to the drive shaft in a respective cylinder chamber a plate is mounted on the ends toward the drive shaft of each of the pistons, and the pistons are movable back and forth radially in the respective cylinder chamber by rotation of the drive shaft. This object is attained in that the plate is pivotably connected to the associated piston. The damage to the plate and/or piston found within the scope of the present invention can be ascribed to a bending stress on the piston. By pivotably connecting the plate to the piston, the load on the piston from moments and bracing forces is reduced. Because of the movable mounting of the plate on the piston, a moment from the plate is prevented from being transmitted to the piston. Thus, even at peak pressures up to 2000 bar, perfect function of the radial piston pump of the invention is assured, even if the individual elements are only partly filled.

A particular version of the invention is characterized in that the plate is retained on the piston by a plate holder. In this kind of radial piston pump braced on the inside, the plate mounted on the ends of each of the pistons has contact with the drive shaft, or with a ring, supported on the drive shaft, that has three flat faces offset from one another by 120°. In operation of the radial piston pump, the pistons are set into a reciprocating motion by the eccentricity of the drive shaft, or by the camlike protrusions on the drive shaft. Relatively major forces are exerted by the rotating drive shaft on the pistons, as a function of the quantities of fuel aspirated into the cylinder chambers, so that pressure is exerted on the fuel. It has been found that in certain operating states (partial filling), the conventionally used plates, plate holders and/or pistons are extremely severely stressed and sometimes also damaged. This can cause a complete failure of the pump. The damage to the plate, plate holder and/or piston ascertained within the scope of the present invention is ascribed to high bending stress on the plate holder and piston from the rotation of the drive shaft, or of the ring that can be disposed between the drive shaft and the plate, if the plate is connected more or less rigidly to the piston via coupling elements. Pivotably connecting the plate to the piston reduces the loading of the plate and the piston from moments and bracing forces. This prevents breakage to the plate, the plate holder, and/or the piston.

A further particular object of the invention is characterized in that the end toward the drive shaft of the piston has the shape of a spherical portion and is received in a corresponding indentation in the middle of the plate. As a consequence of the spherical embodiment of the piston base and the plate, given suitable design, a more-uniform pressure per unit of surface area between the plate and the ring seated on the eccentric shaft is achieved. As a result, the wear that occurs in operation of the radial piston pump is advantageously reduced.

A further particular object of the invention is characterized in that the plate has the shape of a round disk, whose circumferential edge is rounded and tapers toward the drive shaft, and the shape of the plate holder is adapted to the rounded edge of the plate. As a result, in the installed state, tilting of the plate relative to the plate holder is made possible. This offers the advantage that upon rotation (tilting) of the plate, no moment is transmitted to the plate holder or the piston. This reduces the load on the plate holder in operation.

A further particular object of the invention is characterized in that the plate, on the side toward the piston, has a chamfer on the circumference. This facilitates the mounting of the plate. Upon the insertion of the plate into the plate holder, the chamfer of the edge of the plate assures that the plate holder will be spread apart and will easily pass over the plate.

A further particular object of the invention is characterized in that the piston has a collar, which merges with the spherically shaped end portion of the piston. The collar shapes a stop for the plate holder on the piston. As a result, snap rings, which are used in conventional radial piston pumps to fasten the plate holder to the piston and which, as a result of breakage or loosening from the groove, lead to the failure of the pump—especially in the event of partial filling—can be dispensed with.

A further particular object of the invention is characterized in that the piston includes a tappet, whose end toward the drive shaft is embodied as a spherical portion, which is received in a corresponding indentation in the middle of the plate. The spherical embodiment of the piston base and the plate has the consequence not only of mobility of the plate but also that the pressure per unit of surface area decreases. This advantageously reduces the wear that occurs in operation of the radial piston pump.

A further particular object of the invention is characterized in that a groove is provided on the piston between the tappet and the spherical portion, and this groove is engaged by a crimped edge, which is embodied on the plate. The plate is retained on the piston by the crimped edge that engages the groove. Adequate play for the mobility of the connection must be provided for. The geometric dimensioning of the connection is designed such that a relatively low-play degree of freedom of the plate in the vertical direction of at least ±10° can be achieved. Attaching the plate to the piston, as provided by the invention, has the advantage that a plate holder used in conventional radial piston pumps for fastening the plate can be dispensed with. In other words, fewer individual parts are needed, making for economies of cost.

A further particular object of the invention is characterized in that at least one opening is recessed out of the crimped edge. The opening advantageously serves to allow lubricant to be delivered to the piston/plate connection.

A further particular object of the invention is characterized in that the diameter of the spherical portion is slightly smaller than the diameter of the piston. This dimensioning has proved advantageous in practice.

A further particular object of the invention is characterized in that the plate has the shape of a round disk. Other basic shapes of the plate are equally possible, but the round shape has proved advantageous.

A further particular object of the invention is characterized in that the plate, on the side toward the drive shaft, has a chamfer on the circumference. The chamfer interrupts the lower edge of the plate and creates a gentler transition. This reduces the load on the plate in the circumferential region.

A further particular object of the invention is characterized in that the plate has a collar. The collar advantageously acts as a stop for a spring, which keeps the plate in contact with the drive shaft. As a rule, this is a helical spring, which is disposed parallel to the piston and brings about the intake stroke of the piston.

A further particular object of the invention is characterized in that a ring is disposed between the drive shaft and the plate. The ring serves to transmit forces from the eccentrically embodied drive shaft to the plate. The ring is advantageously supported slidingly on the drive shaft. The ring can be embodied either cylindrically or polygonally.

The present invention also relates to a method for producing a radial piston pump as described above. For fastening the plate to the piston, a plate holder is used in conventional radial piston pumps. The fastening of the plate holder to the piston is done by a snap ring. Mounting the plate on the piston is complicated and time-consuming.

It is therefore also an object of the present invention to furnish a method for producing a radial piston pump as described above that can be performed quickly and simply.

In a method for producing a radial piston pump as described above, this object is attained in that the spherical portion of the piston is introduced into the indentation of the plate until the spherical portion rests on the indentation. The crimped edge is then annealed and at the same time deformed with a forming tool toward the spherical portion and/or the groove. As a rule, the plate is first hardened. The ensuing annealing is then done inductively. So-called "hot crimping" has the advantage that the crimped edge springs back again because of the elasticity of the material. This automatically establishes the basic play required for the mobility of the connection. The method furthermore has the advantage that the method can be maximally automated.

The present invention has the general advantage that the fundamental concept of the present invention can be employed in existing radial piston pumps in a simple way. In general, the component strength is increased, especially when the cylinder chambers are only partly filled. The center offset provided in the housing of a conventional radial piston pump does not need to be changed.

Further advantages, characteristics and details of the invention will become apparent from the ensuing description, in which exemplary embodiments are described in detail in conjunction with the drawings. The characteristics mentioned in the description can each be essential to the invention individually or in arbitrary combination. Various ways to embody the invention are described in detail below in conjunction with the drawings.

DETAILED DESCRIPTION

Figure 1:
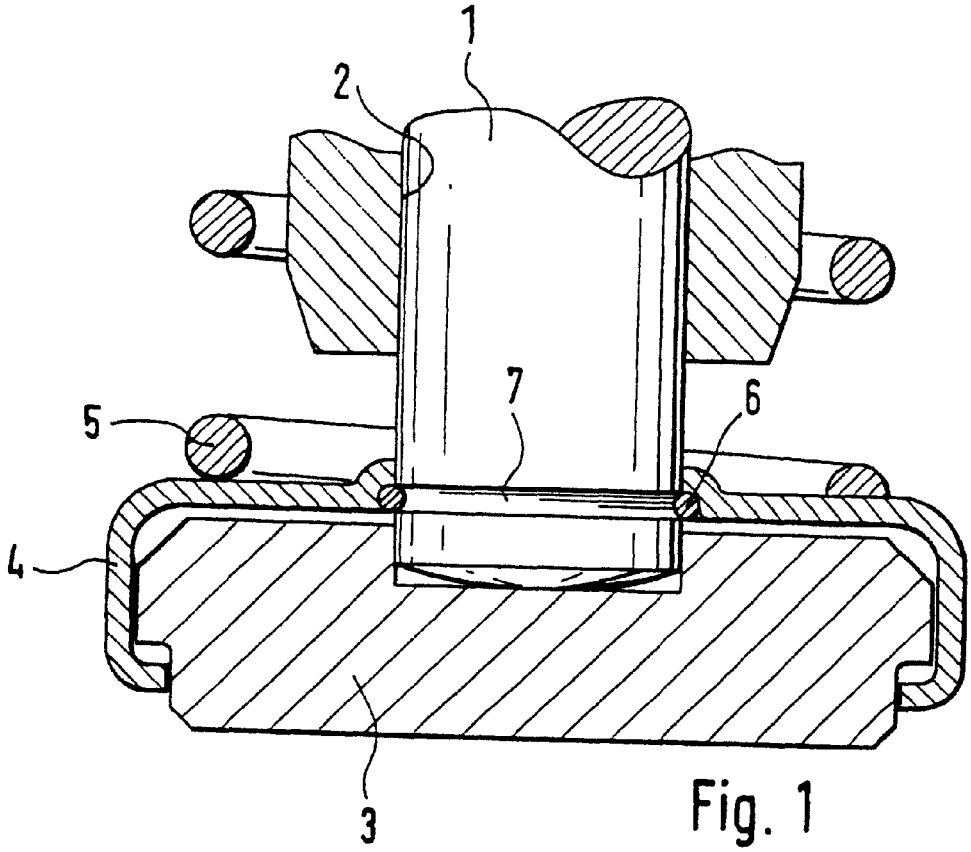
FIG. 1 shows a piston and a plate of a conventional radial piston pump.

FIG. 1 shows a fragmentary view of a conventional radial piston pump for generating high fuel pressure in fuel injection systems of internal combustion engines. In FIG. 1, only the part of the radial piston pump that is critical in the present invention is shown in section. The basic design of a radial piston pump is understood to be known and will therefore be addressed only briefly below.

The radial piston pump is used for generating fuel, particularly in common rail injection systems of internal combustion engines. The term "common rail" means the same as "common line", "common rail" or "common distributor strip". In contrast to conventional high-pressure injection systems, in which the fuel is pumped to the individual combustion chambers over separate lines, the injection nozzles in common rail injection systems are supplied from a common line.

The radial piston pump shown in FIG. 1 includes a drive shaft, supported in a pump housing, with an eccentrically embodied shaft portion. A polygonal ring is provided on the eccentric shaft portion, and the shaft portion is rotatable relative to the polygonal ring. The ring includes a plurality of flat faces, offset from one another, against each of which one piston 1 is braced. Instead of the polygonal ring, a cylindrical ring can also be used. The pistons 1 are each received so as to be capable of reciprocation radially to the drive shaft in a cylinder chamber 2.

As shown in FIG. 1, a plate 3 is fastened to the end of the piston 1 oriented toward the drive shaft. The plate 3 is retained on the associated piston 1 by a plate holder 4, which is also known as a cage. In addition, the plate 3 is pressed against the ring (not shown) by a spring 5. To prevent the plate holder 4 from sliding down from the piston 1, a snap ring 6 is placed in a groove 7 of the piston 1.

Figure 2:
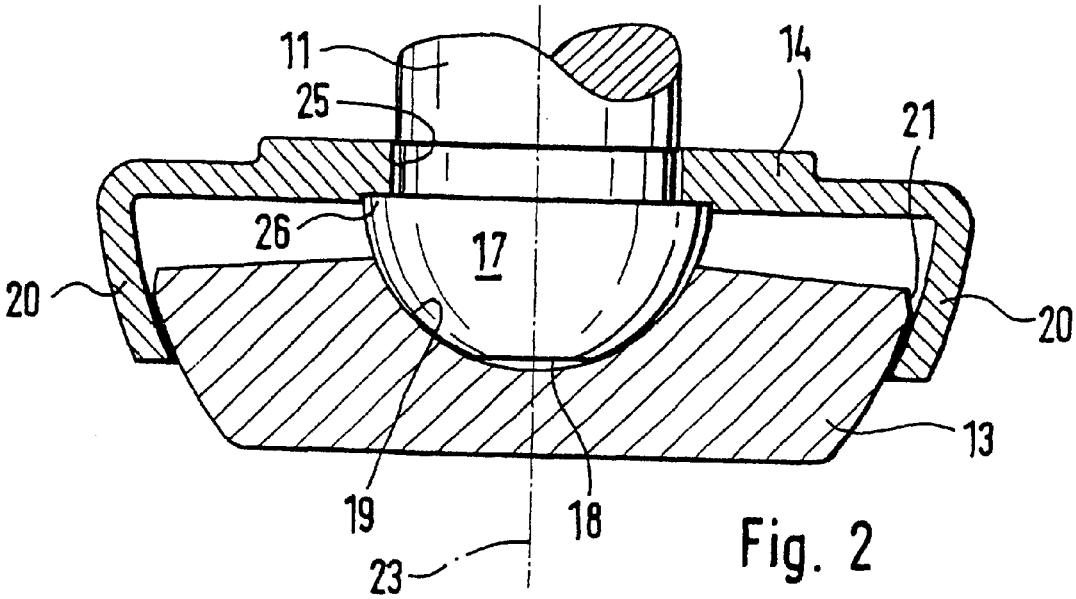
FIG. 2 shows a piston and a plate of a radial piston pump in accordance with the present invention.

FIG. 2 shows how a plate 13 of the present invention is pivotably connected to a piston 11. On end of the piston, the piston 11 has the shape of a hemisphere 17, which is provided with a flat face end 18. The flat face end 18 can also be omitted. The plate 13 has an indentation 19 in the middle, whose shape is adapted to the shape of the hemisphere 17. The plate 13 is pressed against the hemisphere 17 by a plate holder 14.

Because of the spherical embodiment of the contact face between the piston 11 and the plate 13, it is possible for the plate 13 to tilt relative to the piston 11, if a moment is exerted on the plate 13. The tilt of the plate 13 relative to the piston 11 is advantageously promoted by the special embodiment of the plate edge and of the plate holder 14.

Except for the indentation 19, the plate 13 has the shape of a truncated cone, which tapers in the direction away from the piston. The jacket face of the truncated cone is rounded. The plate holder 14 is provided with a plurality of segments 20, whose shape is adapted to the jacket face of the plate 13. A chamfer 21, which facilitates the mounting of the plate 13 on the piston 11, is provided on the outer edge of the plate 13, oriented toward the piston 11.

As a rule, the plate holder 14 is made from an elastic material. If in the mounting process the plate 13 is moved concentrically toward the hemisphere 17 that belongs to the piston 11, the segments 20 spread apart once they come into contact with the chamfer 21. Because of the tapering of the plate 13, the segments 20 move together again once the plate 13 with the indentation 19 rests on the hemisphere 17 of the piston 11.

The plate holder 14 has a round opening 25 in the middle, through which the piston 11 protrudes, in the installed state. The edge of the opening 25 of the plate holder 14 is at a stop against a shoulder 26 that is formed on the piston 11. This retains the plate holder on the piston 11. A snap ring 6 (see FIG. 1) of the kind used in conventional radial piston pumps can therefore be omitted. Finally, FIG. 2 also shows that the piston 11, plate holder 14 and plate 13 have a common axis of symmetry 23.

The radial piston pump, shown only in part in FIGS. 1 and 2, serves to subject fuel, which is furnished from a tank by a prefeed pump, to high pressure. The fuel subjected to high pressure is then pumped into the aforementioned common rail.

Figure 3:
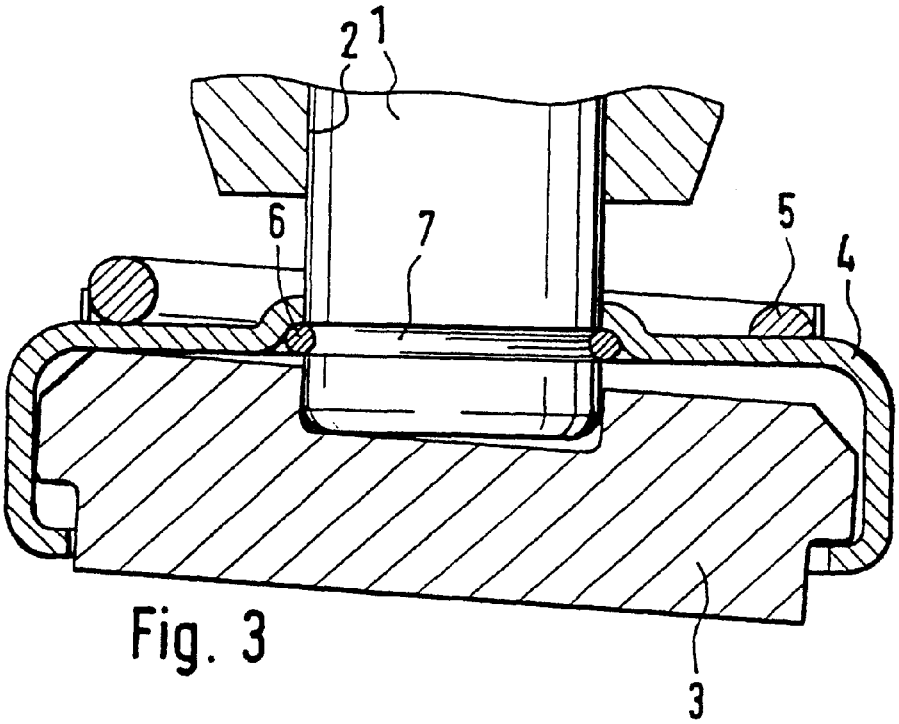
FIG. 3 shows a piston and a plate of a conventional radial piston pump.

FIG. 3 shows a portion of a conventional radial piston pump for generating high fuel pressure in fuel injection systems of internal combustion engines. In FIG. 3, only the part of the radial piston pump that is critical in the present invention is shown in section. The basic structure of a radial piston pump is shown in cross section in FIG. 7.

FIG. 3 shows a piston 1 that can move back and forth in a cylinder chamber 2. A plate 3 is secured to the free end of the piston 1. The plate 3 is retained on the piston 1 by a plate holder 4, also known as a cage or spring plate. In addition, the plate 3 is subjected to a compressive force by a spring 5. To prevent the plate holder 4 from sliding down from the piston 1, a snap ring 6 is mounted in a groove 7 of the piston 1.

In operation of the radial piston pump, the plate 3 sometimes rotates relative to the piston 1 in the plate holder 4. The rotation of the plate can lead to damage and breakage of the plate, piston and/or plate holder. This problem that occurs in conventional radial piston pumps is solved by the present invention.

Figure 4:
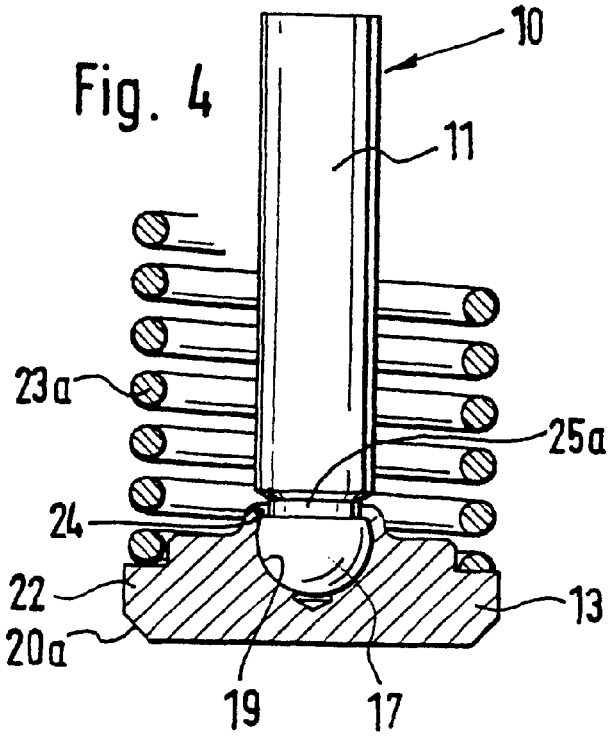
FIG. 4 shows a piston and a plate of a radial piston pump in accordance with the present invention in section.

In FIG. 4, it is shown how a plate 13 of the present invention is pivotably connected to a tappet 11 of a piston designated overall by reference numeral 10. The end of the tappet 11 takes the form of a ball 17. The plate 13 has an indentation 19 in the middle serving as a joint socket. Because of the spherical embodiment of the contact face between the tappet 11 and the plate 13, it is possible for the plate 13 to rotate relative to the tappet 11 if a moment is exerted on the plate 13.

The plate 13, on the side remote from the piston 10, is provided with a chamfer 20*a*. The chamfer 20*a* changes into a collar 22. The collar 22 forms a stop for a spring 23*a*.

The indentation 19 is enclosed by a crimped edge 24. In the assembled state, the crimped edge 24 engages a groove 25*a*, which is embodied on the piston 10 between the tappet 11 and the ball 17. There is enough play available between the crimped edge 24 and the ball 17, or groove 25*a*, that the plate 13 can move relative to the piston 10.

Figure 5:
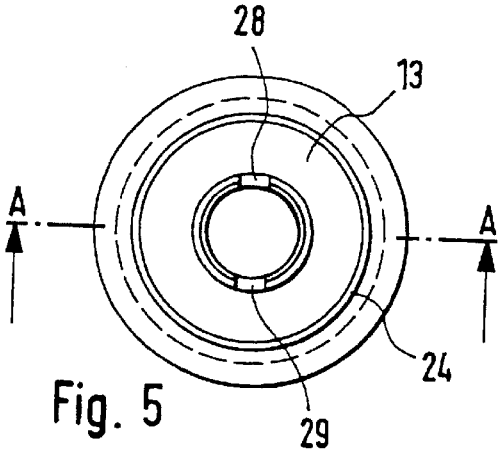
FIG. 5 shows a plan view on the plate of FIG. 4 before it is mounted on the piston.
Figure 6:
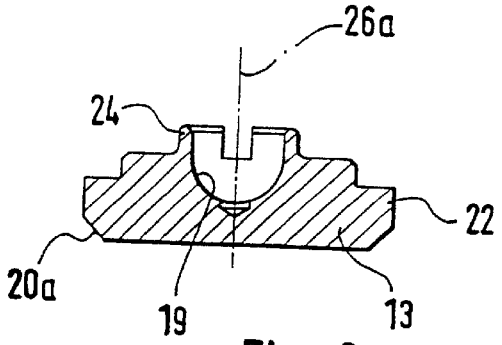
FIG. 6 shows a section through the plate of FIG. 5 taken along the line A—A.

In FIGS. 5 and 6, the plate 13 is shown before it is mounted on the piston. In FIG. 6, it can be seen that the crimped edge 24 of the plate 13 extends parallel to the center line 26*a* of the plate 13. In comparison, the crimped edge 24 in FIG. 4 is curved slightly inward. In the state shown in FIG. 6, the ball 17 can be brought into contact, in the mounting process, with the surface of the indentation 19. The crimped edge 24 can then be annealed inductively and pressed against the piston with the aid of a corresponding tool. After the annealing, the crimped edge 24 retreats on its own, because of the elasticity of the material used, far enough that the aforementioned play between the crimped edge 24 and the ball 17 is attained. The crimped edge 24 is then in the slightly inward-curved state shown in FIG. 4, in which the plate 13 is pivotably connected to the piston 10.

As best shown in FIG. 5, two openings 28, 29 are provided in the crimped edge 24, which serve the purpose of lubricating the connection between the piston 10 and the play 13.

Figure 7:
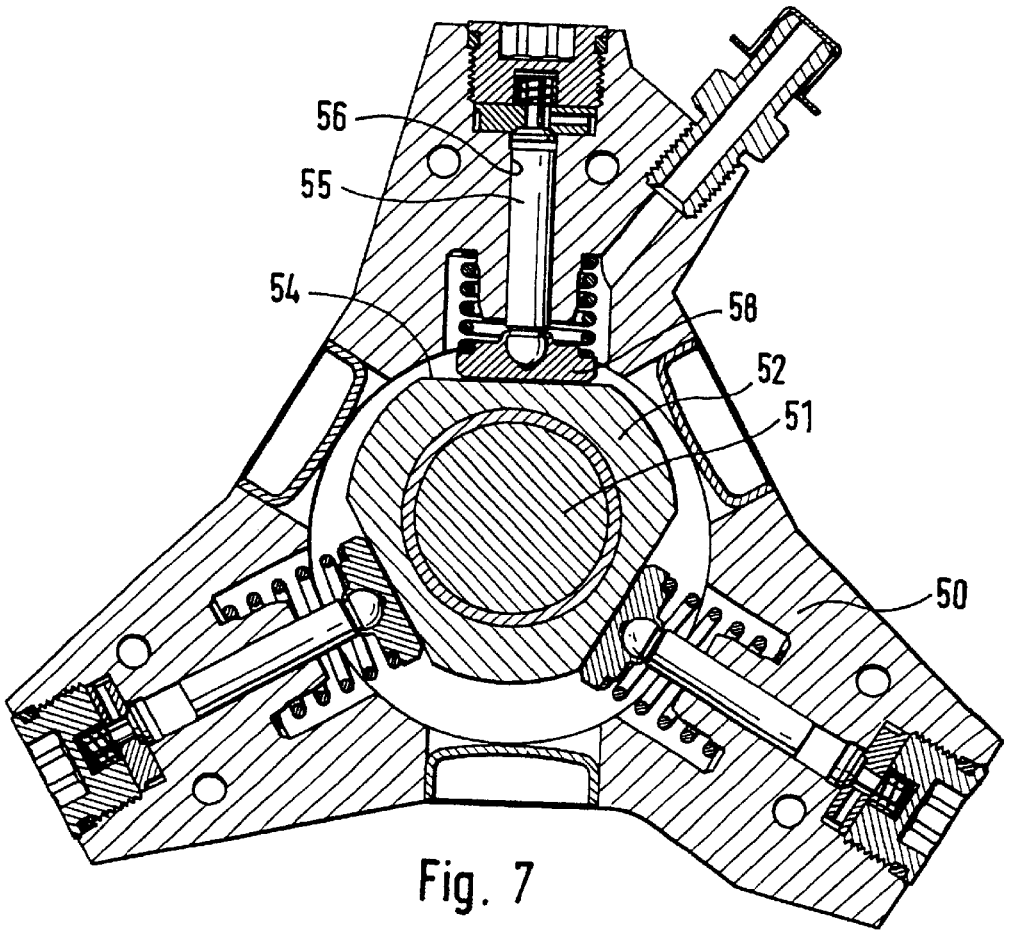
FIG. 7 shows a radial piston pump of the invention in section.

In FIG. 7, one complete radial piston pump in accordance with present invention is shown. The radial piston pump is used for generating fuel for diesel engines, particularly in common rail injection systems of internal combustion engines. The term "common rail" means the same as "common line", "common rail" or "common distributor strip". In contrast to conventional high-pressure injection systems, in which the fuel is pumped to the individual combustion chambers over separate lines, the injection nozzles in common rail injection systems are supplied from a common line.

The radial piston pump shown in FIG. 7 includes a drive shaft, supported in a pump housing 50, with an eccentrically embodied shaft portion 51. A polygonal ring 52 is provided on the eccentric shaft portion, and the shaft portion is rotatable relative to it. The ring 52 includes three flat faces 54, offset from one another, against each of which one piston 55 is braced. Instead of the polygonal ring 52, a cylindrical ring can also be used. The pistons 55 are each received so as to be capable of reciprocation radially to the drive shaft in a cylinder chamber 56. One plate 58 is pivotably connected to each of the pistons 55. The connection between the piston 55 and the plate 58 is shown enlarged in FIG. 4, which is described above.

The radial piston pump shown in FIG. 7 serves to subject fuel, which is furnished from a tank by a prefeed pump, with high pressure. The fuel acted upon by high pressure is then pumped into a common distributor strip (common rail).

The foregoing relates to a preferred exemplary of embodiments of the invention, it being understood that other variants and embodiments thereof are possible within the spirit and scope of the invention, the latter being defined by the appended claims.

What is claimed is:

1. A method for producing a radial piston pump for generating high fuel pressure in a common rail of a fuel injection system of internal combustion engines, forming an eccentric drive shaft (51) which is supported in a pump housing (50), forming a plurality of pistons (1, 10, 55) with spherical end portions which are disposed radially with respect to the drive shaft (51) in respective cylinder chambers (2, 56) of said piston pump, forming a piston plate (3, 13, 58) with a flat face on an end surface with a spherical indentation in a surface directing opposite said flat face, which is pivotably mounted on an end of each of the pistons with the flat face toward the drive shaft (51), forming a ring (52) with flat faces (54) which is disposed between the drive shaft and the flat faces of the piston plate (13, 58) in which the ring (52) and the piston plate moves the pistons (1, 10, 55) back and forth radially in the respective cylinder chambers (2, 56) by rotation of the drive shaft (51).

2. A radial piston pump for generating high fuel pressure in fuel injection systems including a common rail of internal combustion engines comprising a drive shaft (51) which is supported in a pump housing (50) and is embodied eccentrically, a plurality of pistons (1, 10, 55), disposed radially with respect to the drive shaft (51) in respective cylinder chambers (2, 56), a piston plate (3, 13, 58) is mounted on ends of each of the pistons, toward the drive shaft (51), the pistons (1, 10, 55) are movable back and forth radially in the respective cylinder chambers (2, 56) by rotation of the drive shaft (51), a ring (52) with flat faces (54) is disposed between the drive shaft and the piston plate (13, 58), with the flat faces toward the drive shaft, and the piston plate (13, 58) is pivotably connected to an associated piston (10, 55).

3. The radial piston pump of claim 2, in which the piston plate (3, 13) is retained on the piston (11) by a plate holder (4, 14).

4. The radial piston pump of claim 3, in which the end of the piston (11) toward the drive shaft has a shape of a spherical portion (17) and is received in a corresponding indentation (19) in a middle portion of the piston plate (13).

5. The radial piston pump of claim 3, wherein the piston plate (13) has a shape of a round disk, including a rounded circumferential edge which tapers toward the drive shaft, and a shape of the plate holder (14) is adapted to the rounded edge of the piston plate (13).

6. The radial piston pump of claim 4, which in the piston plate (13) has a shape of a round disk, including a rounded circumferential edge which tapers toward the drive shaft, and a shape of the plate holder (14) is adapted to the rounded edge of the piston plate (13).

7. The radial piston pump of claim 3, in which the piston plate (13), on the side toward the piston (11), has a chamfer (21) on the circumference.

8. The radial piston pump of claim 4, in which the piston plate (13), on the side toward the piston (11), has a chamfer (21) on the circumference.

9. The radial piston pump of claim 5, in which the piston plate (13), on the side toward the piston (11), has a chamfer (21) on the circumference.

10. The radial piston pump of claim 3, in which the piston (11) has a collar (26), which changes over to a spherical portion-shaped end (17) of the piston (11).

11. The radial piston pump of claim 4, in which the piston (11) has a collar (26), which changes over to a spherical portion-shaped end (17) of the piston (11).

12. The radial piston pump of claim 5, in which the piston (11) has a collar (26), which changes over to a spherical portion-shaped end (17) of the piston (11).

13. The radial piston pump of claim 2, wherein the piston (10, 55) includes a tappet (11), whose end toward the drive shaft is embodied as a spherical portion (17), which is received in a corresponding indentation (19) in the middle portion of the piston plate (13, 58).

14. The radial piston pump of claim 13, in which a groove **(25*a*) is provided on the piston (10, 55) between the tappet (11) and the spherical portion (17), and the groove is engaged by a crimped edge (24), which is embodied on the piston plate (13, 58)**.

15. The radial piston pump of claim 14, in which at least one opening (28, 29) is recessed out of the crimped edge (24).

16. The radial piston pump of claim 13, in which the diameter of the spherical portion (17) is slightly smaller than a diameter of the piston (10, 55).

17. The radial piston pump of claim 13, in which the plate (13, 58) has the shape of a round disk.

18. The radial piston pump of claim 13, wherein the piston plate (13, 58), on the side toward the drive shaft, has a chamfer **(20*a*)** on the circumference.

19. The radial piston pump of claim 14, wherein the piston plate (13, 58), on the side toward the drive shaft, has a chamfer **(20*a*)** on the circumference.

20. The radial piston pump of claim 13, wherein the piston plate (13, 58) has a collar (22).

* * * * *